US007699641B2

(12) United States Patent
Bright et al.

(10) Patent No.: US 7,699,641 B2
(45) Date of Patent: Apr. 20, 2010

(54) ELECTRICAL CONNECTOR ASSEMBLY HAVING A RELEASE MECHANISM

(75) Inventors: Edward John Bright, Middletown, PA (US); Harold William Kerlin, Port Royal, PA (US)

(73) Assignee: Tyco Electronics Corporation, Middletown, PA (US)

( * ) Notice: Subject to any disclaimer, the term of this patent is extended or adjusted under 35 U.S.C. 154(b) by 236 days.

(21) Appl. No.: 12/032,342

(22) Filed: Feb. 15, 2008

(65) Prior Publication Data

US 2009/0209125 A1 Aug. 20, 2009

(51) Int. Cl.
*H01R 13/627* (2006.01)

(52) U.S. Cl. ..... 439/352

(58) Field of Classification Search ..... 439/352, 439/358, 595; 385/53, 88, 92

See application file for complete search history.

(56) References Cited

U.S. PATENT DOCUMENTS 6,851,867 B2 2/2005 Pang et al.
7,090,523 B2 8/2006 Shirk et al.

OTHER PUBLICATIONS

"QSFP"; Copper High Speed Assemblies,;Amphenol Interconnect Products Corp.; www.amphenol-aipc.com (1 page), Jul. 25, 2007.

*Primary Examiner*—Briggitte R Hammond

(57) ABSTRACT

An electrical connector module configured to form a communicative connection with a host device is provided. The module includes a housing that is configured to be inserted into a receptacle of the host device. The housing extends substantially in an axial direction and includes a surface. The module also includes an actuating member that is slidably coupled to and movable along the surface of the housing from a locked position to a disengaged position. The module includes a spring member that is positioned on the actuating member and configured to exert a force against the housing and the actuating member. The spring member is biased in order to maintain the actuating member in the locked position.

20 Claims, 7 Drawing Sheets

ELECTRICAL CONNECTOR ASSEMBLY HAVING A RELEASE MECHANISM

BACKGROUND OF THE INVENTION

The subject matter described herein relates generally to electrical connector assemblies, and more particularly to release mechanisms for pluggable module assemblies.

Pluggable module assemblies allow users of electronic equipment or external devices to transfer data to or communicate with other equipment and devices. The module assemblies are constructed according to established standards for size and compatibility (e.g., Small Form-factor Pluggable (SFP), XFP, or Quad Small Form-factor Pluggable (QSFP)). Generally, a module assembly includes a connector module (e.g., transceiver) that is configured to be inserted into a receptacle for establishing a communicative connection with an electrical device or system. The connector module has a front end, a rear end, and a cavity extending axially between the front and rear ends. The connector module may include a circuit board that is held within the cavity and configured to project outward from the front end. When the connector module is inserted into the receptacle, the circuit board engages a slot within the receptacle that is configured to receive the circuit board. The connector module may also include a pair of opposing actuator arms that extend axially along sides of the connector module. The actuator arms may be movable along retention slots formed by the sides of the connector module. The receptacle includes sidewalls that form a passage therebetween. The sidewalls have latch elements that project into the passage of the receptacle. As the connector module advances into the receptacle, the latch elements from sidewalls contact and engage a cavity in the sidewall of the connector module thereby holding the connector module within the receptacle.

In one conventional module assembly the connector module includes an ejector mechanism. The ejector mechanism includes a bail that has a pair of base portions where each base portion couples to one of the actuator arms. The bail and actuator arms are configured such that the bail is pivotable from an upright position to an angled position. When the bail is pivoted from the upright position to the angled position, the base portions cause the actuator arms to retract toward the rear end of the connector module. When the actuator arms retract, the latch elements disengage from the actuator arms thereby allowing the connector module to be removed from the receptacle. However, after the actuator arms are retracted, the bail remains in the angled position and the actuator arms remain retracted. In order to return the actuator arms to the locked position, the bail must be forced back into the upright position by a user of the connector module.

Furthermore, in another conventional module assembly the actuator arms are integrally formed and coupled to each other by a bar or beam extending therebetween. In order to retract the actuator arms, the bar may be gripped and pulled backward causing the actuator arms to slide rearward within the retention slots. However, the actuator arms may be in rigidly fixed positions with respect to each other. As such, the manufacturing tolerances may be small, which may lead to an increase in defective parts and manufacturing costs.

Thus, there is a need in the industry for connector assemblies that have self-resetting release mechanisms. Furthermore, there is a need for connector assemblies that may tolerate slight misalignments between the actuator arms.

BRIEF DESCRIPTION OF THE INVENTION

In one embodiment, an electrical connector module configured to form a communicative connection with a host device is provided. The module includes a housing that is configured to be inserted into a receptacle of the host device. The housing extends substantially in an axial direction and includes a surface. The module also includes an actuating member that is slidably coupled to and movable along the surface of the housing from a locked position to a disengaged position. The module includes a spring member that is positioned on the actuating member and configured to exert a force against the housing and the actuating member. The spring member is biased in order to maintain the actuating member in the locked position.

Optionally, the actuating member and the outer surface of the housing form a chamber therebetween. The housing may include a projection that extends into the chamber, and the spring member may exert a force against the projection and the actuating member. Also, the spring member may be a torsion spring.

In another embodiment, an electrical connector assembly is provided and includes a receptacle that is coupled to a host device. The receptacle extends substantially in an axial direction. The connector assembly also includes a connector module. The connector module includes a housing that is configured to be inserted into a receptacle of the host device. The housing extends substantially in an axial direction and includes a surface. The connector module also includes an actuating member that is slidably coupled to and movable along the surface of the housing from a locked position to a disengaged position. The actuating member and the housing form a chamber therebetween. Furthermore, the connector module includes a spring member that is positioned within the chamber and configured to exert a force against the housing and the actuating member. The spring member is biased in order to maintain the actuating member in the locked position.

DETAILED DESCRIPTION OF THE INVENTION

Figure 1:
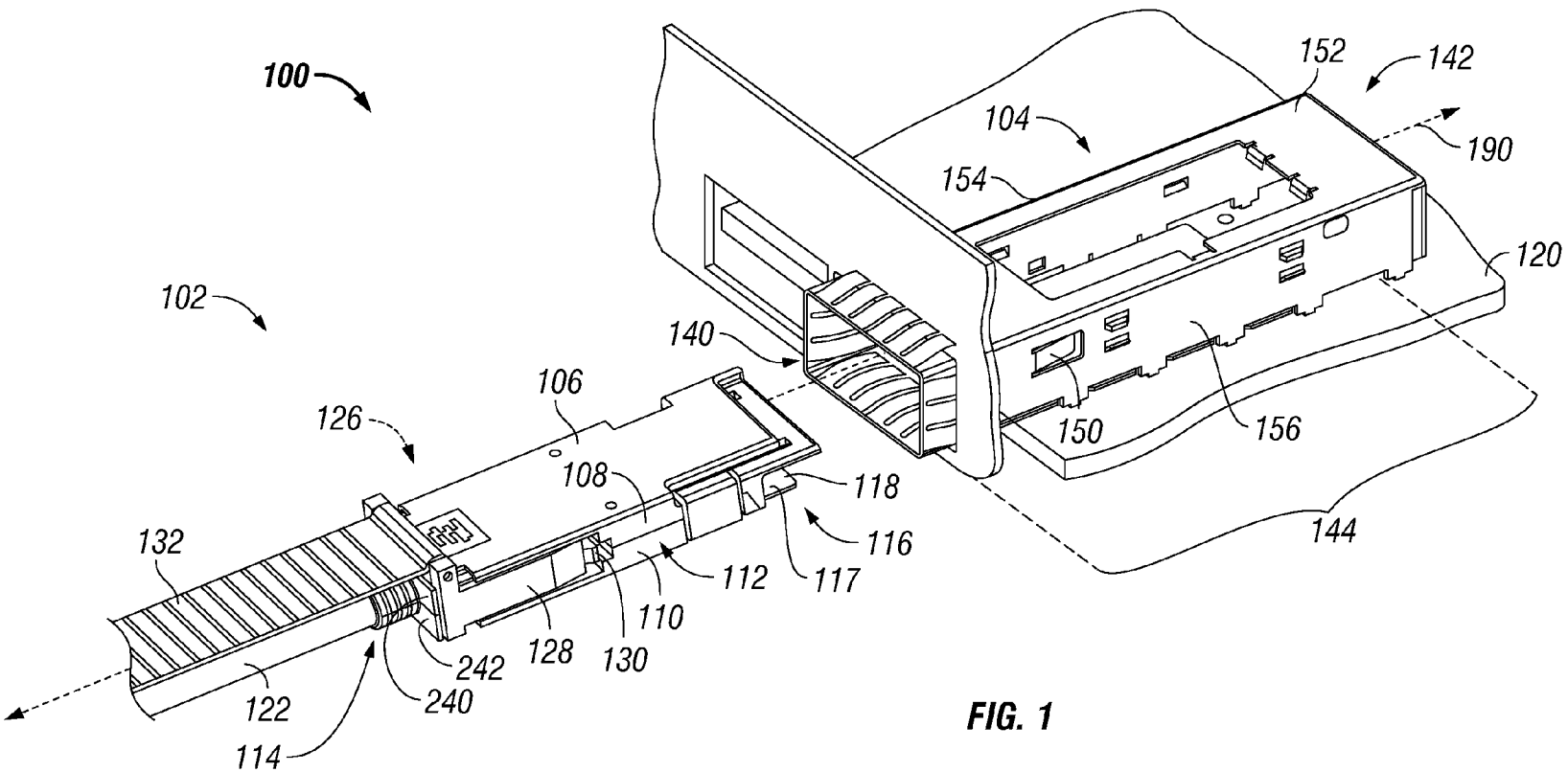
FIG. 1 is a perspective view of a connector assembly including a connector module and a receptacle formed in accordance with one embodiment.

FIG. 1 is a perspective view of an electrical connector assembly 100 formed in accordance with one embodiment and includes a connector module 102 and a receptacle 104. The connector module 102 is configured to be inserted into the receptacle 104. The connector module 102 includes a housing 106 that may be formed from two housing shells 108 and 110 that mate or engage with each other along an interface 112, only a portion of which is shown in FIG. 1. The connector module 102 has a front end 116, a rear end 114, and a cavity (not shown) that extends axially from the front end 116 to the rear end 114. The front end 116 is configured for pluggable insertion into the receptacle 104. The receptacle 104 may be attached to a circuit board 120 of a host electrical device (not shown). The electrical device may be, for example, a router, switch, storage system or other portable electronic device. The front end 116 of the connector module 102 includes an electrical component 117, which is illustrated in FIG. 1 as a circuit board 118, configured to couple with the electrical device in order to establish a communicative connection. The connector module 102 also includes a cable 122 that extends into the cavity at the rear end 114 and connects with the circuit board 118 within the housing 106 using one or more conductors (not shown). The connector module 102 may be used to convey data signals from one electrical device to another, and more particularly to convey data signals at high frequencies, such as 10 gigabits per second (Gbs). When in operation, the connector module 102 is engaged to the receptacle 104 and forms a communicative connection with the electrical device allowing the data signals to transmit through the cable 122 and circuit board 118 and into the electrical device. The connector module 102 may be an electrical or optoelectronic connector. In one embodiment, the connector module 102 is a direct attach connector module 102 that is configured to be a Small Form-factor Pluggable (SFP), XFP, or Quad Small Form-factor Pluggable (QSFP) connector.

Also shown in FIG. 1, the receptacle 104 has an opening 140, a rear end 142, and a passage 144 extending therebetween. The receptacle 104 includes an electrical receiver (not shown) positioned at the rear end 142 and configured to receive the circuit board 118 of the connector module 102. The receptacle 104 includes a guideframe 152 having opposing sidewalls 154 and 156 that define the passage 144 therebetween. The guideframe 152 is configured to direct the connector module 102 toward the rear end 142 along a central axis 190 when the connector module 102 is inserted into the receptacle 104. Also shown, the receptacle 104 includes latch elements 150 that extend inwardly from the sidewalls 154 and 156 into the passage 144 and into the path of the connector module 102.

Figure 2:
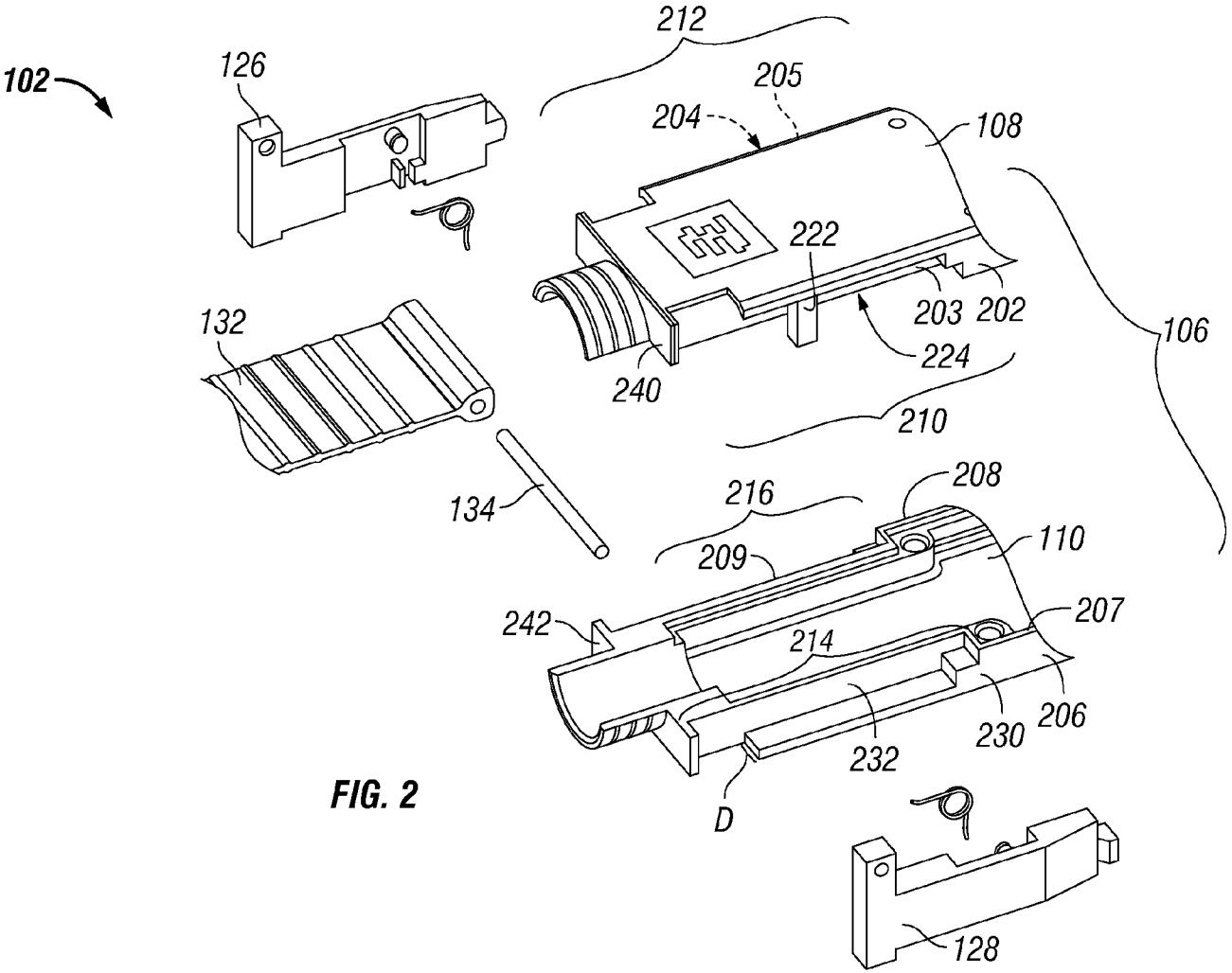
FIG. 2 is an exploded view of the connector module shown in FIG. 1.

FIG. 2 is an exploded view of the connector module 102 illustrating the separate parts and components of the connector module 102 before assembly. The housing shell 108 includes opposing sides 202 and 204, which each have an edge 203 and 205, respectively, that extends a length of the housing shell 108. The housing shell 110 includes opposing sides 206 and 208, which each have an edge 207 and 209, respectively, that extends a length of the housing shell 110. When the housing shells 108 and 110 are mated together to form the connector module 102, the edges 207 and 203 engage each other along the interface 112 (FIG. 1). Likewise, the edges 209 and 205 engage each other along an interface (not shown) when the housing shells 108 and 110 are mated together. The housing shell 108 also includes recessed portions 210 and 212 formed by sides 202 and 204, respectively, and the housing shell 110 includes recessed portions 214 and 216 formed by the sides 206 and 208, respectively. Each recessed portion 210, 212, 214, and 216 may have a recessed depth D (only shown with respect to recessed portion 214) measured from an outer surface 230 of the corresponding side 206 to an inner surface 232 of the corresponding recessed portion 214. One or more projections 222 may extend from a surface of the recessed portion 210 and/or 212 or, alternatively, from a surface of the recessed portion 214 and/or 216. More specifically the projection 222 extends from an overhang surface 224 of the corresponding recessed portion and substantially perpendicular to the central axis 190 (FIG. 1) when the connector module 102 is assembled. As will be discussed in greater detail below, when the housing shells 108 and 110 are mated together along the interface 112, the recessed portions 210 and 214 form an actuator slot 220 (FIGS. 6 and 8) that is configured to hold a slidable actuating member 128. Similarly when the housing shells 108 and 110 are mated together along the interface, the recessed portions 212 and 216 form an actuator slot (not shown) that is configured to hold a slidable actuating member 126.

With reference to FIGS. 1 and 2, the housing shells 108 and 110 may each include a rear stop 240 and 242, respectively, that extends a width of the housing 106. The connector module 102 may also include a grip element 132 that couples to the rear end 114 (FIG. 1) and facilitates gripping and removing the connector module 102 from the receptacle 104 when in operation. More specifically the grip element 132 may hold a retaining element 134 (FIG. 2) that is removably coupled to and extends between the actuating members 126 and 128.

Figure 3:
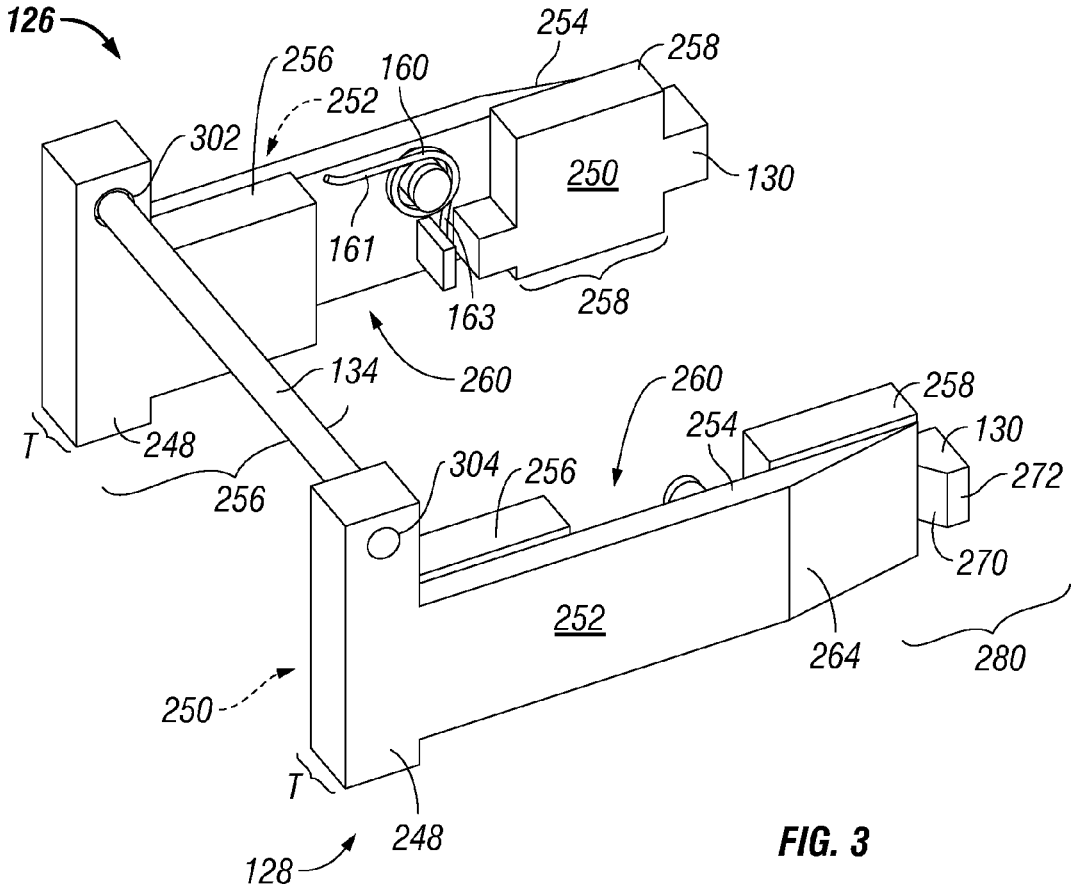
FIG. 3 is a perspective view of opposing actuating members that may be used with the connector module shown in FIG. 1.

FIG. 3 is an isolated perspective view of the actuating members 126 and 128 arranged opposite to each other and connected by the retaining element 134. Each of the actuating members 126 and 128 may include a body 248 having a planar inner surface 250, a planar outer surface 252, and an edge 254 extending therebetween. Furthermore, the body 248 includes a rear portion 256, a front portion 258, and a chamber portion 260 extending between the front and rear portions 256 and 258. The body 248 also has a thickness T that is substantially equal to or slightly less than the depth D (FIG. 2) of the corresponding recessed portion 216 (FIG. 2). Ejector arms 130 may extend axially outward from the front portion 258. On the outer surface 252, the ejector arms 130 include a ramped surface 270 and a planar ledge surface 272 that face the sidewall 156 (FIG. 1) when the connector module 102 is inserted into the guideframe 152 (FIG. 1). As shown with respect to the actuating member 128, the outer surface 252 includes a tapered end portion 264 that extends axially toward the ejector arm 130 and away from the guideframe sidewall 156 into the ramped surface 270. The tapered end portion 264 and the ramped surface 270 form a holding mechanism 280 that interacts with the latch element 150 (FIG. 1) when the connector module 102 is inserted into the receptacle 104. More specifically the holding mechanism 280 in FIG. 3 is a latch cavity or indentation formed by the tapered end portion 264 and the ramped surface 270.

Also shown, the actuating member 126 may include a spring member 160 that is positioned within the chamber portion 260. As will be discussed in greater detail below, the spring member 160 is compressible and may utilize stored energy to facilitate moving the actuating member 126 substantially along the axial direction when the connector module 102 (FIG. 1) is assembled. In FIG. 3, the spring member 160 is a torsion spring having a pair of legs 161 and 163 that are perpendicular with respect to each other. However, other spring members 160 may be used. For example, the spring member 160 may be a coil spring. In an alternative embodiment, the spring member 160 may be integrated with the projection 222 (FIG. 2) or the front portion 258. For example, the spring member 160 may extend from an inner edge wall of the front portion 258 such that the spring member 160 extends into the chamber portion 260 and is biased to exert a force against the projection 222.

Also shown in FIG. 3, the actuating members 126 and 128 are connected to each other by the retaining element 134. The retaining element 134 includes opposing ends that are removably coupled to the actuating members 126 and 128 and may be, for example, a spring pin, bar, rod, beam, or the like. When assembling the connector module 102, the retaining element 134 may be inserted through a hole 304 of the rear portion 256 of the actuating member 128 and into a hole 302 of the actuating member 126. The hole 302 is smaller in diameter than a diameter of the retaining element 134 thereby permitting the retaining element 134 to be press fit into the hole 302. The dimensions of the retaining element 134 and the holes 302 and 304 are such that the retaining element allows some movement of the actuating members 126 and 128 with respect to each other, i.e., the actuating members 126 and 128 are not held in rigidly fixed positions with respect to each other. More specifically, the retaining element 134 allows slight misalignments between the actuating members 126 and 128. For example, when the actuating members 126 and 128 are assembled with the connector module 102, the actuating member 126 may be advanced slightly further along the central axis 190 (FIG. 1) than the actuating member 128. Furthermore, the actuating members 126 and 128 may be slightly vertically misaligned. As such, the retaining element 134 allows for greater manufacturing tolerances than would be allowed if the actuating members 126 and 128 were in a rigid fixed relationship with respect to each other. Such manufacturing tolerances may not be allowed, for example, when the actuating members 126 and 128 are integrally formed from a rigid material.

Figure 4:
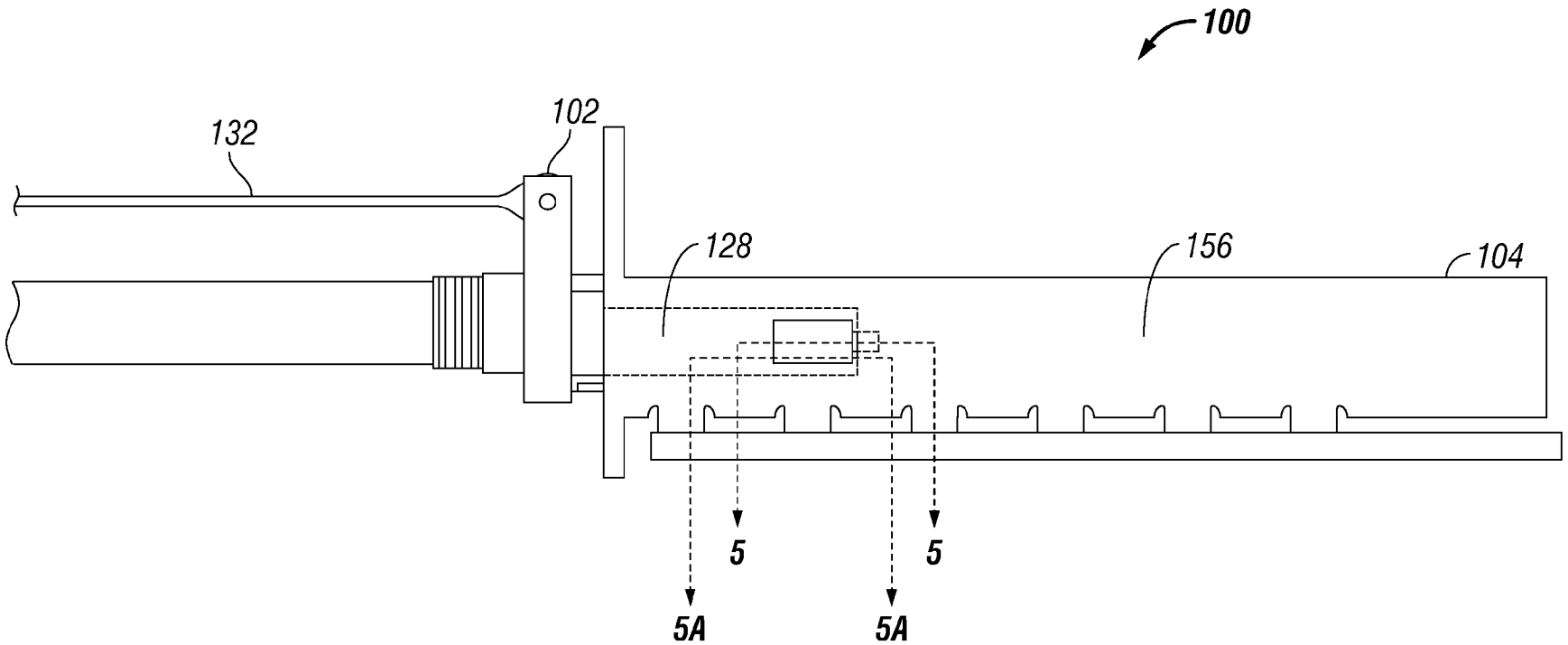
FIG. 4 is a side view of the connector assembly shown in FIG. 1 when the connector module is fully engaged with the receptacle.

FIG. 4 is a side view of the connector assembly 100 illustrating the connector module 102 in an engaged or locked position with the receptacle 104. As will be discussed in greater detail below, the actuating members 126 and 128 are slidably coupled to the housing shells 108 and 110 (FIG. 2) and movable along or near the interface 112 (FIG. 1) between a locked position and a disengaged position. When moving between the locked and disengaged positions, the ejector arms 130 of the actuating members 126 and 128 interact with latch elements 150 (FIG. 1) of the receptacle 104 (FIG. 1) for engaging and disengaging the connector module 102 with the receptacle 104.

Figure 5:
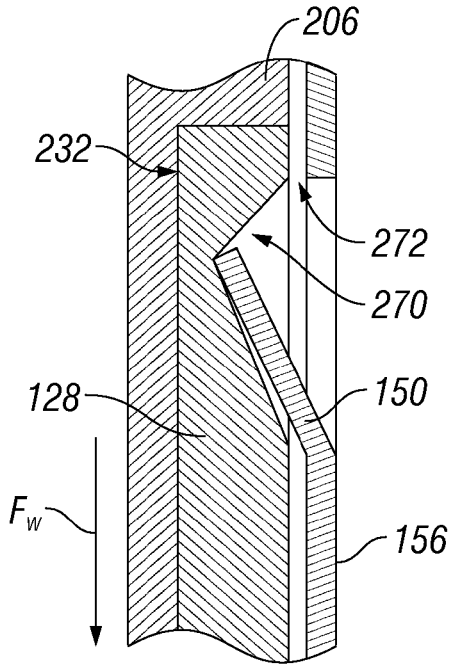
FIG. 5 is a planar cross-sectional view of the actuating member and the receptacle taken along a line 5-5 in FIG. 4.
Figure 5A:
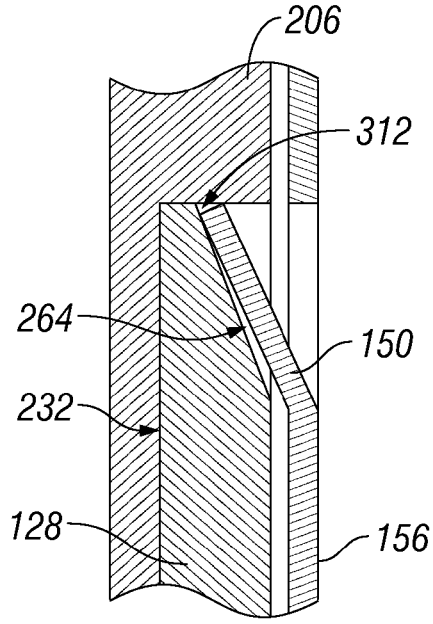
FIG. 5A is a planar cross-sectional view of the actuating member and the receptacle taken along a line 5A-5A in FIG. 4.
Figure 6:
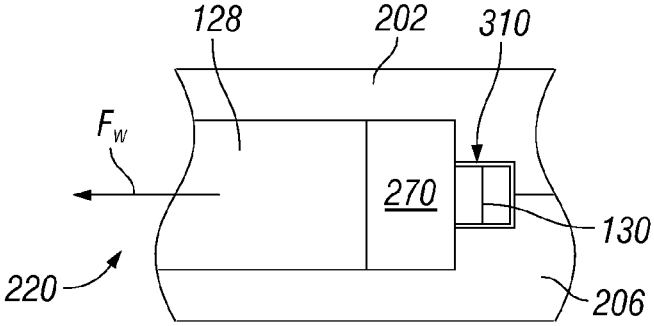
FIG. 6 is an enlarged side view of the actuating member shown in FIG. 5.

FIGS. 5 and 5A are cross-sectional views of the actuating member 128 and the sidewall 156 taken along a center line 5-5 and a base line 5A-5A, respectively, shown in FIG. 4, and FIG. 6 is an enlarged side view of the actuating member 128 shown in FIG. 5. Although the following discussion is described with specific reference to the actuating member 128, the description may similarly be applied to the actuating member 126. As shown in FIG. 6, while in the engaged position the ejector arm 130 is positioned within an arm notch 310, which extends outward from the actuator slot 220. As shown in FIG. 5A, while in the engaged position the latch element 150 is flexed inward away from a plane formed by the sidewall 156 and engaged with the tapered end portion 264 and a shoulder wall 312. The shoulder wall 312 extends outward from the inner surface 232 to the outer surface 230 in a perpendicular manner. When a user desires to remove the connector module 102 (FIG. 1) from the receptacle 104 (FIG. 1), the grip element 132 (FIG. 1) may be pulled with a withdrawing force $F_W$ in a direction that is substantially parallel to or along the central axis 190 (FIG. 1). With reference to FIGS. 5 and 5A, when the actuating member 128 begins to slide in a front-to-rear direction, the latch element 150 slides against the ramped surface 270 (FIG. 5). As the actuating member 128 is withdrawn, the latch element 150 is deflected outward by the ramped surface 270 until the latch element 150 is able to clear the shoulder wall 312 and slide along the planar ledge surface 272 (FIG. 5) and onto the sides 202 and 206.

Figure 7:
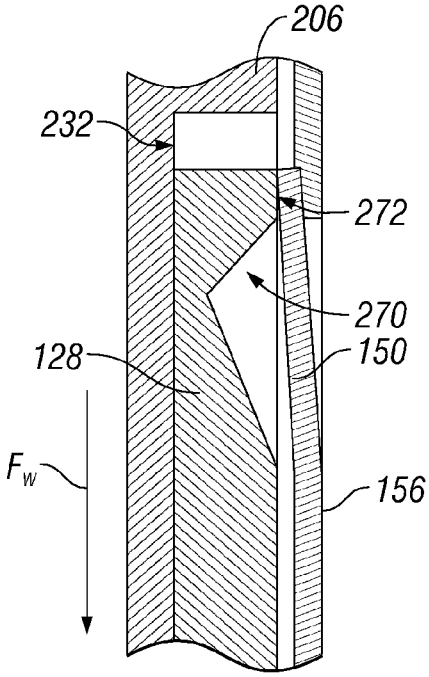
FIG. 7 is a planar cross-sectional view of the actuating member and the receptacle in FIG. 5 after the actuating member has been disengaged with the receptacle.
Figure 8:
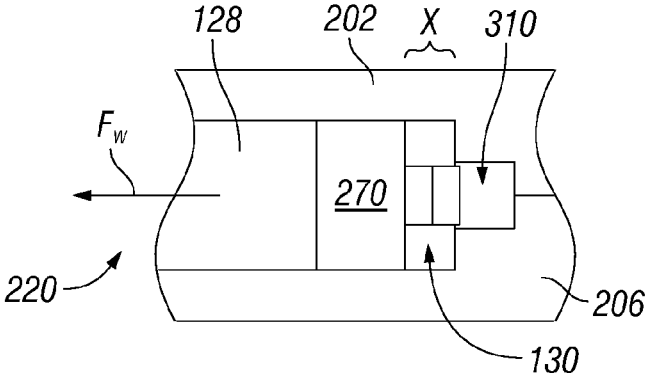
FIG. 8 is an enlarged side view of the actuating member shown in FIG. 7.

FIG. 7 is a cross-sectional view of the actuating member 128 and the sidewall 156 shown in FIG. 5 when the latch element 150 is deflected and contacts the ledge surface 272. As the connector module 102 (FIG. 1) is withdrawn the latch element 150 slides along the sides 202 and 206 (FIG. 6). FIG. 8 is an enlarged side view of the actuating member 128 shown in FIG. 7 when the actuating member 128 is in a disengaged position. When the actuating member 128 has withdrawn a distance X, the spring member 160 (FIG. 3) is in a flexed condition and the actuating member 128 is in the disengaged position. At this point, the connector module 102 then begins to disengage with the receptacle 104 and slides in a front-to-rear direction. The latch element 150 is configured such that the sides 202 and 206 (FIG. 2) of the connector module 102 slide underneath the latch element 150 allowing the connector module 102 to be removed from the receptacle 104.

Figure 9:
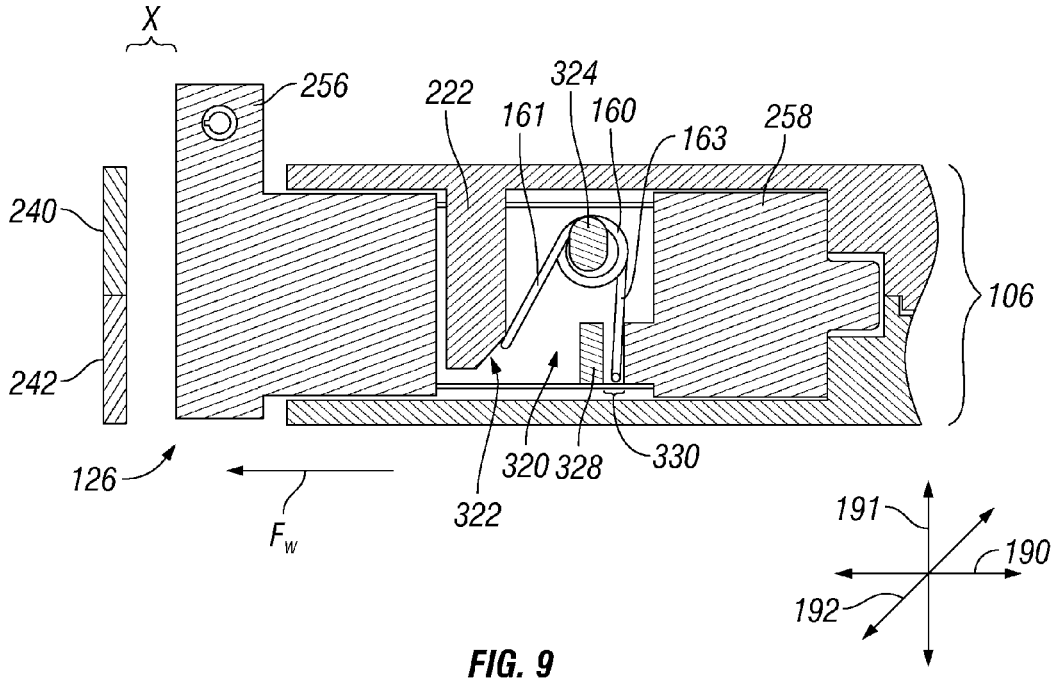
FIG. 9 is a side view of the actuating member in the locked position illustrating the spring member in a flexed condition.
Figure 10:
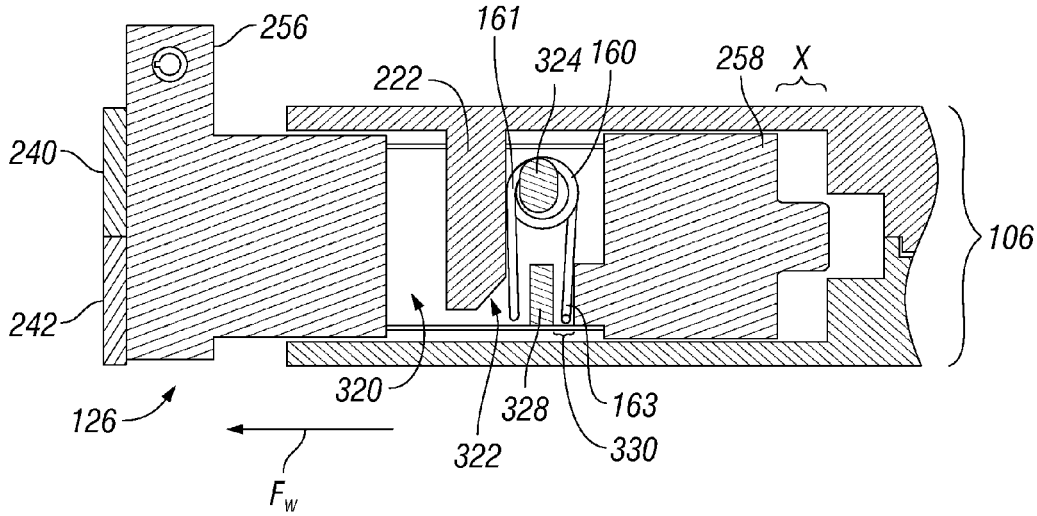
FIG. 10 is a side view of the actuating member in the disengaged position illustrating the spring member in a compressed condition.

FIGS. 9 and 10 illustrate the interaction between the spring member 160, the actuating member 126, and the housing 106 (FIG. 1) when the actuating member 126 moves from the locked position (FIG. 9) to the disengaged position (FIG. 10). When the connector module 102 is assembled, the chamber portion 260 (FIG. 3) and the inner surface 232 (FIG. 2) of the housing 106 (FIG. 1) form a chamber 320 therebetween. The chamber portion 260 is open at the top and bottom allowing the projection 222 to extend into and substantially across a height of the chamber 320. The projection 222 extends substantially perpendicular to the central axis 190, i.e., along or parallel to the vertical axis 191. Alternatively, the projection 222 may extend from the inner surface 232 of the housing 106 in a direction that is along or parallel to the z-axis 192 and extend substantially the thickness T (FIG. 3) of the actuating member 126. The projection 222 may include a beveled edge 322 directed toward the spring member 160. The beveled edge 322 aids in compressing the spring member 160 from a free state to a flexed condition during the assembly of the actuating member 126 into the housing 106. The actuating member 126 may also include a holder 324 that extends from the inner surface 250 (FIG. 3) of the chamber portion 260 toward the housing 106. The holder 324 is configured to hold the spring member 160. In one embodiment, the spring member 160 rests upon the holder 324. Alternatively, the holder 324 is fastened to the spring member 160. As discussed above, the spring member 160 includes a pair of legs 161 and 163. When assembled, the leg 163 is inserted into a notch 330 defined between a block 328 and the front portion 258. As such, the leg 163 is held in a substantially fixed position with respect to the leg 161.

When the actuating member 126 is moved from the locked position (FIG. 9) to the disengaged position (FIG. 10), the spring member 160 changes from a flexed condition (FIG. 9) to a compressed condition (FIG. 10). In the flexed condition, a portion of the leg 161 of the spring member 160 may partially contact the beveled edge 322. Furthermore, in the flexed condition, the leg 161 forms a non-orthogonal angle with respect to the central axis 190 or the vertical axis 191.

When the withdrawing force $F_W$ is applied, the actuating member 126 moves the distance X until the rear portion 256 abuts the rear stops 240 and 242. At such time, the actuating member 126 is in the disengaged position and the spring member 160 is in the fully compressed condition (FIG. 10). In the fully compressed condition, the legs 161 and 163 are substantially parallel with respect to each other and substantially perpendicular to the central axis 190. The spring member 160 has stored energy for exerting a force against the projection 222 along the central axis in the direction of the withdrawing force $F_W$. If the withdrawing force $F_W$ continues to be applied, the connector module 102 may then be removed from the receptacle 104. When the withdrawing force $F_W$ is released the stored energy in the spring member 160 causes the leg 161 to flex against the projection 222 and slide the actuating member 126 back into the locked position. As such, the connector module 102 provides a self-resetting release mechanism.

In an alternative embodiment, the holder 324 extends from the housing 106 and the spring member 160 is held by the housing 106. The leg 161 may be held in a vertical fixed position and the leg 163 may be flexed from an angled position to a vertical position. When the actuating member 126 is pulled in a front-to-rear direction by the withdrawing force $F_W$, the leg 163 may flex against the front portion 258. When the withdrawing force FW is released, the leg 163 may exert a force against the front portion 258 thereby causing the actuating member 126 to slide into the locked position.

It is to be understood that the above description is intended to be illustrative, and not restrictive. As such, the above-described embodiments (and/or aspects thereof) may be used in combination with each other. Furthermore, the dimensions, types of materials, orientations of the various components, and the number and positions of the various components described herein are intended to support parameters of certain embodiments, and are by no means limiting and are merely exemplary embodiments.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed:

1. An electrical connector module configured to be inserted into a receptacle to form a communicative connection with a host device, the connector module comprising:

a housing configured to be inserted into the receptacle, the housing extending substantially in an axial direction and including an outer surface;

an actuating member slidably coupled to and movable along the outer surface of the housing from a locked position to a disengaged position; and a spring member positioned on the actuating member and configured to exert a force against the housing and the actuating member, the spring member being biased to maintain the actuating member in the locked position with respect to the housing.

2. The module in accordance with claim 1 wherein the actuating member and the outer surface of the housing form a chamber therebetween, the housing including a projection that extends into the chamber, the spring member exerting a force against the projection and the actuating member.

3. The module in accordance with claim 1 wherein the actuating member is movable in substantially the axial direction.

4. The module in accordance with claim 3 wherein the projection extends substantially perpendicular to the axial direction.

5. The module in accordance with claim 1 wherein the spring member is integrally formed with the actuating member and extends from an inner edge wall of the actuating member.

6. The module in accordance with claim 1 wherein the spring member is a torsion spring.

7. The module in accordance with claim 6 wherein the torsion spring includes a first leg and a second leg, the first leg being in a substantially fixed position.

8. The module in accordance with claim 6 wherein the torsion spring includes a first leg and a second leg, the first and second legs extending substantially perpendicular to the axial direction when the actuating member is in the disengaged position.

9. The module in accordance with claim 1 wherein, when the actuating member is in the disengaged position, the spring member is in a compressed condition.

10. The module in accordance with claim 1 wherein the actuating member is a first actuating member and the connector module further comprises a retaining element and a second actuating member slidably coupled to and movable along the outer surface of the housing from a locked position to a disengaged position, wherein the first and second actuating members oppose each other and are removably coupled to opposite ends of the retaining element.

11. An electrical connector assembly comprising:

a receptacle coupled to a host device and extending substantially in an axial direction;

a connector module configured to be inserted into the receptacle for making a communicative connection with the host device, the module comprising a housing having an outer surface, an actuating member slidably coupled to and movable along the outer surface from a locked position to a disengaged position, and a spring member positioned on the actuating member and configured to exert a force against the housing and the actuating member, the spring member being biased to maintain the actuating member in the locked position.

12. The connector assembly in accordance with claim 11 wherein the actuating member and the outer surface of the housing form a chamber therebetween, the housing including a projection that extends into the chamber, the spring member exerting a force against the projection and the actuating member.

13. The module in accordance with claim 11 wherein the actuating member is movable in substantially the axial direction.

14. The connector assembly in accordance with claim 13 wherein the projection extends substantially perpendicular to the axial direction.

15. The connector assembly in accordance with claim 11 wherein the spring member is integrally formed with the actuating member and extends from an inner edge wall of the actuating member.

16. The connector assembly in accordance with claim 11 wherein the spring member is a torsion spring.

17. The connector assembly in accordance with claim 16 wherein the torsion spring includes a first leg and a second leg, the first leg being in a substantially fixed position.

18. The connector assembly in accordance with claim 16 wherein the torsion spring includes a first leg and a second leg, the first and second legs extending substantially perpendicular to the axial direction when the actuating member is in the disengaged position.

19. The connector assembly in accordance with claim 11 wherein, when the actuating member is in the disengaged position, the spring member is in a compressed condition.

20. The connector assembly in accordance with claim 11 wherein the actuating member is a first actuating member and the connector module further comprises a retaining element and a second actuating member slidably coupled to and movable along the outer surface of the housing from a locked position to a disengaged position, wherein the first and second actuating members oppose each other and are removably coupled to opposite ends of the retaining element.

* * * * *